US011654348B2

(12) United States Patent
Islam

(10) Patent No.: US 11,654,348 B2
(45) Date of Patent: May 23, 2023

(54) BOARD GAME RELATING TO THE COVID-19 PANDEMIC

(71) Applicant: Shahan Islam, Wilton, CT (US)

(72) Inventor: Shahan Islam, Wilton, CT (US)

(73) Assignee: Category Ten LLC, Wilton, CT (US)

( * ) Notice: Subject to any disclaimer, the term of this patent is extended or adjusted under 35 U.S.C. 154(b) by 164 days.

(21) Appl. No.: 16/873,725

(22) Filed: Jun. 16, 2020

(65) Prior Publication Data

US 2021/0387081 A1 Dec. 16, 2021

(51) Int. Cl.
*A63F 3/00* (2006.01)

(52) U.S. Cl.
CPC ..... *A63F 3/00072* (2013.01); *A63F 3/00006* (2013.01); *A63F 2003/00018* (2013.01); *A63F 2300/20* (2013.01)

(58) Field of Classification Search
CPC ..... A63F 3/00072; A63F 3/00006; A63F 2003/00018; A63F 2300/20; A63F 3/00478; A63F 2003/0492; A63F 3/00063
See application file for complete search history.

(56) References Cited

U.S. PATENT DOCUMENTS 748,432 A 1/1904 Magie
2,026,082 A * 12/1935 Darrow ..... A63F 3/00072 D21/350
2,178,330 A * 10/1939 Thomas ..... A63F 3/0457 273/254
2,693,961 A * 11/1954 Ripley, Jr. ..... A63F 3/00072 273/256
3,334,703 A * 8/1967 Zeller ..... F02N 15/10 60/357
3,807,739 A * 4/1974 Henley ..... A63F 3/00072 273/256
3,826,499 A * 7/1974 Lenkoff ..... A63F 3/00895 273/287
3,858,885 A * 1/1975 Adcock ..... A63F 3/00072 273/243
3,884,475 A * 5/1975 Munro ..... A63F 3/00088 273/256
3,885,792 A * 5/1975 Breslow ..... A63F 3/00138 273/256
4,114,891 A * 9/1978 Lawrimore ..... A63F 3/00091 273/250

(Continued)

OTHER PUBLICATIONS https://www.euractiv.com/section/coronavirus/news/coronavirus-board-game-to-teach-and-entertain-italian-kids/ accessed Feb. 12, 2021.

(Continued)

*Primary Examiner* — David L Lewis
*Assistant Examiner* — Matthew D Hoel
(74) *Attorney, Agent, or Firm* — Myers Wolin, LLC

(57) ABSTRACT

A board game which creates an entertaining playing and learning environment pertaining to the Covid-19 pandemic, comprises a game board with spaces thereon corresponding to geographical locations or places which have significance to the novel coronavirus pandemic, game pieces for each player to move around the board, dice to be rolled to advance game pieces along the board, currency, various learning elements including information cards and said locations or places, all working together to create a fun and learning environment.

20 Claims, 7 Drawing Sheets

(56) References Cited

U.S. PATENT DOCUMENTS 4,136,879 A * 1/1979 Andrew ..... A63F 3/0478 273/243
4,136,881 A * 1/1979 Anspach ..... A63F 3/00072 273/256
4,162,075 A * 7/1979 Iannucci ..... A63F 3/00072 273/256
4,174,840 A * 11/1979 Curtiss ..... A63F 3/0478 273/243
4,189,153 A * 2/1980 Zollinger ..... A63F 3/00072 273/256
4,302,016 A * 11/1981 Astle ..... A63F 3/00063 273/278
4,372,559 A * 2/1983 Summers ..... G09B 3/04 273/243
4,456,259 A * 6/1984 Antal ..... A63F 3/00072 273/256
4,456,260 A * 6/1984 Hilton ..... A63F 3/00072 273/256
4,497,490 A * 2/1985 Rogers, Jr. ..... A63F 3/00072 273/142 JA
4,618,151 A * 10/1986 Fadner ..... A63F 3/06 273/148 A
4,648,601 A * 3/1987 Carmichael ..... A63F 3/00072 273/241
4,767,119 A * 8/1988 Fadner ..... A63F 3/06 273/148 A
4,830,379 A * 5/1989 Richard ..... A63F 3/00028 273/141 R
4,904,808 A * 2/1990 Devon ..... C07F 15/008 556/136
4,927,156 A * 5/1990 Breslow ..... A63F 3/00072 273/256
4,932,668 A * 6/1990 Stewart ..... A63F 3/00072 273/243
4,946,169 A * 8/1990 Hofmann ..... A63F 3/00072 273/253
4,966,371 A * 10/1990 Sherman ..... A63F 3/00006 273/146
5,120,065 A * 6/1992 Driscoll ..... A63F 3/00643 273/237
5,228,860 A * 7/1993 Hale ..... G09B 19/22 434/129
5,788,238 A * 8/1998 LeBriton ..... A63F 3/0423 273/272
5,810,359 A * 9/1998 Wilkins ..... A63F 3/00072 273/256
6,164,650 A * 12/2000 Wilkins ..... A63F 3/00072 273/256
6,672,590 B1 * 1/2004 Olsen ..... A63F 9/18 273/248
6,979,265 B2 * 12/2005 Suzuki ..... A63F 13/005 463/31
7,204,693 B2 * 4/2007 Nagle ..... A63F 3/00072 273/256
7,214,065 B2 * 5/2007 Fitzsimmons, Jr. ..... G09B 5/00 434/236
7,828,655 B2 * 11/2010 Uhlir ..... A63F 13/61 463/30
7,967,678 B2 * 6/2011 Dougherty ..... A63F 13/10 463/30
7,970,749 B2 * 6/2011 Uhlir ..... A63F 13/65 707/705
8,025,565 B2 * 9/2011 Leen ..... G07F 17/3223 463/23
8,105,141 B2 * 1/2012 Leen ..... A63F 9/0468 463/1
8,342,924 B2 * 1/2013 Leen ..... G07F 17/3276 463/1
8,342,946 B2 * 1/2013 Amaitis ..... G06Q 50/34 463/25
8,342,966 B2 * 1/2013 Storm ..... G07F 9/002 463/42
8,556,691 B2 * 10/2013 Leen ..... G07C 15/006 463/1
8,562,439 B2 * 10/2013 Shuman ..... A63F 13/65 463/42
10,699,528 B2 * 6/2020 Leen ..... G07F 17/3255
10,699,529 B2 * 6/2020 Leen ..... G07F 17/3234
10,720,012 B2 * 7/2020 Amaitis ..... G07F 17/3293
10,850,184 B1 * 12/2020 Colvin ..... F24F 8/22
10,946,110 B1 * 3/2021 Colvin ..... F24F 8/22
11,040,271 B1 * 6/2021 Sines ..... A61L 2/10
11,074,784 B2 * 7/2021 Leen ..... G07F 17/32
11,087,598 B2 * 8/2021 Amaitis ..... G07F 17/3244
11,097,024 B1 * 8/2021 Colvin ..... A61L 2/10
11,097,025 B1 * 8/2021 Colvin ..... A61L 2/24
11,137,601 B2 * 10/2021 Wieczorek ..... A63F 13/428
11,185,760 B1 * 11/2021 Sines ..... A61L 2/202
11,200,776 B2 * 12/2021 Amaitis ..... G07F 17/3269
11,213,740 B1 * 1/2022 Loane ..... A63F 1/02
2007/0278741 A1 * 12/2007 Woodbury ..... A63F 3/00006 273/249
2009/0252646 A1 * 10/2009 Holden ..... A61L 2/202 422/24
2021/0008443 A1 * 1/2021 Fishkin ..... A63F 3/0457
2021/0096656 A1 * 4/2021 Gilg ..... G06F 40/143
2021/0132380 A1 * 5/2021 Wieczorek ..... A63F 13/00
2021/0265055 A1 * 8/2021 Murdock ..... A61B 5/0205
2021/0299568 A1 * 9/2021 Kurth ..... A63F 13/46
2021/0322588 A1 * 10/2021 Colvin ..... A61L 2/24
2021/0322603 A1 * 10/2021 Colvin ..... A63F 1/12
2021/0356149 A1 * 11/2021 Warren ..... A61L 2/10
2021/0373676 A1 * 12/2021 Jorasch ..... G06F 3/016
2021/0386887 A1 * 12/2021 Colvin ..... G07F 17/3209
2021/0387081 A1 * 12/2021 Islam ..... A63F 3/00006
2021/0405366 A1 * 12/2021 Wieczorek ..... A63F 13/00
2022/0118351 A1 * 4/2022 Joseph ..... A63F 3/0478
2022/0339527 A1 * 10/2022 Seeley ..... A63F 11/0074
2022/0379193 A1 * 12/2022 Ankner ..... A63F 9/04

OTHER PUBLICATIONS https://www.zmangames.com/en/games/pandemic/; accessed Feb. 12, 2021.
https://www.livemint.com/mint-lounge/features/it-s-time-to-play-covid-19-11585896885350.html; accessed Feb. 12, 2021.
https://www.businessinsider.in/science/news/the-plague-inc-creators-made-a-new-version-of-the-game-that-lets-users-save-the-planet-from-a-pandemic-instead-of-destroying-it/articleshow/74815913.cms; accessed Feb. 12, 2021.
https://www.covidopoly.io/; accessed Feb. 17, 2021.

* cited by examiner

Mask

DURING THE PANDEMIC, YOU ASK YOURSELF, WHO ARE THESE PEOPLE IN YOUR HOUSE AND DO YOU REALLY HAVE TO FEED THEM ALL!

PAY BANK $100.

BOARD GAME COVIDOPOLY 19

Mask

YOU RUN OUT OF TOILET PAPER. NEW YORK TIMES IS A POOR SUBSTITUTE. HEY, TIMES ARE ROUGH.

PAY BANK $50.

BOARD GAME COVIDOPOLY 19

Mask

DURING THE LOCKDOWN, TWIZZLERS AND OREOS BECOME YOUR STAPLE ITEMS.

PAY BANK $50

BOARD GAME COVIDOPOLY 19

Mask

YOU TESTED POSITIVE, BUT ONLY HAD MILD SYMPTOMS; CONSIDER YOURSELF FORTUNATE.

GET FROM BANK $100.

BOARD GAME COVIDOPOLY 19

Mask

EMERGENCY SHOPPING AT COSTCO, BUT WORE MASK AND STAYED AT LEAST SIX FEET AWAY FROM OTHERS.

GET FROM BANK $100.

BOARD GAME COVIDOPOLY 19

Mask

GOT TESTED USING NASAL SWAB-REAL-TIME REVERSE TRANSCRIPTION POLYMERASE CHAIN REACTION (RRT-PCR) FROM A NASOPHARYNGEAL SWAB. YOU ARE FINE.

GET FROM BANK $200.

BOARD GAME COVIDOPOLY 19

FIG. 4

BOARD GAME RELATING TO THE COVID-19 PANDEMIC

FIELD OF THE INVENTION

The present invention relates to board games and more particularly to a board game germane to the Covid-19 pandemic in that the board layout/design and the steps experienced in playing the game teaches about the Covid-19 pandemic and social responsibility during the pandemic.

BACKGROUND OF THE INVENTION

Board games have existed for many millennia. For example, the royal game of Ur, which bears some resemblance to Backgammon, originated in ancient Mesopotamia around 3000 BC and continues to be played today. Other board games, which have been popular, including Parchessi, developed from an earlier version of the game from India, checkers and chess of course and Risk, developed in the $20^{th}$ century.

Around 1903, Elizabeth Magie developed the Landlord's Game (U.S. Pat. No. 748,626), which bore many characteristics of a game called Zohn Ahl, played by the Kiowa Native American tribe. The Landlord's Game was intended to incorporate certain teaching feature including the effect of land ownership and the charging of rent on the population. Numerous other games include teaching rudiments. The game of Risk, for instance, supports, in a fun way, learning about geography and Trivial Pursuit imparts knowledge about many subjects.

The game Monopoly may have heavily borrowed from the Landlord's Game and Zohn Ahl and is the subject of U.S. Pat. No. 2,026,082 (Darrow), which teaches a game board comprising twenty-two streets or areas of Atlantic City, N.J., USA. The game also includes "Chance" and "Community Chest" cards which impart some financial or other penalty or benefit. The Monopoly game allows players to move to different real estate locations which they may purchase.

Neither the Darrow nor the Magie patents however teach a game board comprising 24 (or any number of) geographical locations or places in colored groupings of threes, wherein the geographical locations or places have some significance to the novel coronavirus 2019-2020 pandemic. Further, neither teaches the game board including four tax or penalty spaces which address examples of economic loss suffered in different ways during the pandemic, including (1) rent money lost by a person who returned to live with parents, (2) loss of insurance coverage over a telemedicine visit, (3) loss from use of ineffective immunity test kits and (4) loss of a bed and breakfast deposit. Further, neither reference teaches the game board having the four corner spaces including a Begin Journey space, Go into ICU Quarantine space, In Quarantine/Only Visiting space and an Obtain Stimulus Funds space or "Mask" and "Ventilator" cards having educational and amusing aspects.

The Plague, a game created in 2012, allows users to destroy the world with a novel pathogen and, in a newer version, players may save the world from a virus. The Plague however does not teach a board game with Mask cards, Ventilator cards or tax or penalty cards, including examples of economic loss suffered in different ways during the pandemic. It also does not teach a board game with 40 spaces comprising 24 geographical locations or places in colored groupings of threes, wherein the geographical locations or places have some significance to the novel coronavirus 2019-2020 pandemic, wherein other spaces include four world leading hospitals, a Mobile Testing Unit and a Telemedicine Call Center in India.

Pandemic is a known game board game in which players treat infections around the world while gathering resources for cures. Pandemic however does not teach a board game with Mask cards, Ventilator cards or tax or penalty cards, including examples of economic loss suffered in different ways during the pandemic or a board game with 40 spaces comprising 24 geographical locations or places in colored groupings of threes, wherein the geographical locations or place having some significance in the novel coronavirus 2019-2020 pandemic or other spaces including four world leading hospitals, a Mobile Testing Unit and a Telemedicine Call Center in India.

In December, 2019, an infectious disease caused by the Covid-19 (severe acute respiratory syndrome coronavirus 2) (SARS-CoV-2) virus was first discovered in China. On Jan. 30, 2020, the World Health Organization declared the novel coronavirus outbreak a Public Health Emergency and a pandemic on Mar. 11, 2020. Within weeks after its discovery, the virus spread and caused massive illness throughout the world population, leading to hundreds of thousands of deaths. To combat the spread, countries undertook various measures, including cleanliness vigilance (hand washing, sanitization, etc. . . . ), imposition of social distancing measures, closing of businesses, schools, etc. . . . requiring use of masks to prevent transfer of the virus through air droplets, etc. . . .

Daily lives have been greatly altered by the pandemic. People have become more self-sufficient and have been guided by leaders of respective countries through the difficult times. It has become apparent that the more that people know about the pandemic, how the virus is spread, what is good social behavior, etc. . . . the more lives that will be saved. During the pandemic, families and groups of people remained more at home. The home has become the office, the school, the gym, etc. . . . . More activities have become necessary to occupy time together. It would be advantageous if such activities included an educational component, particularly as relating to the pandemic.

A Coronavirus board game (CBG) is known and teaches and entertain Italian kids about the coronavirus. The CGB reference also states that it is also known that a group of students from the LUMSA University in Rome has launched "L'oca in quarantena" ("The goose in quarantine") which teaches children how to protect themselves from the virus through recommendations and questions related to proper behavior. The CBG however does not teach a board game with Mask cards, Ventilator cards or tax or penalty cards, including examples of economic loss suffered in different ways during the pandemic. Further, the CBG does not teach a board game with 40 spaces comprising 24 geographical locations or places in colored groupings of threes, wherein the geographical locations or places have some significance in the novel coronavirus 2019-2020 pandemic and spaces which include four world-leading hospitals, a Mobile Testing Unit and a Telemedicine Call Center in India.

The "Fight Against Corona" has some similarities to the popular board-game Life and has special blocks, such as an "Infected" block which leads a player to hospitalization. If you go to a "Restaurant" or a "Conference" block, you are directed to a path that requires you to wash your hands. The fight against Corona however does not however teach a board game with Mask cards, Ventilator cards or tax or penalty cards, including examples of economic loss suffered in different ways during the pandemic. It further does not teach a board game with 40 spaces comprising 24 geographical locations or places in colored groupings of threes and includes geographical locations or places have some significance in the novel coronavirus 2019-2020 pandemic, wherein other spaces include four world leading hospitals, a Mobile Testing Unit and a Telemedicine Call Center in India.

It is therefore an object of the present invention to provide a playing environment in which players learn about the novel coronavirus and the Covid-19 pandemic of 2019-2020.

Another object of the invention is to provide a playing environment in which players learn about world leaders, scientists and entertainers who have had an influential role during the novel coronavirus pandemic and about places which have been more adversely affected.

A further object of the invention is to provide a game in which players may learn about some places which have significance during the novel coronavirus pandemic and to invest in hospitals and clinics.

An additional object of the invention is to teach about economic loss during the pandemic.

Still another object of the invention is to stimulate discussion about the novel coronavirus pandemic and social responsibility.

SUMMARY OF THE INVENTION

These and other objects of the invention, which shall become hereafter apparent, are achieved by a Board Game Relating to the Covid-19 Pandemic, comprising a preferably square game board having spaces corresponding to 24 different locations which are geographical or are hospitals, etc. . . . or have some significance to the novel coronavirus pandemic. As players move around the board, they may purchase locations as well as clinics or hospitals for the locations, collect or pay rent, pay taxes or penalties based on examples of economic loss suffered in different ways during the pandemic, as well as learn facts, useful or otherwise, relating to the pandemic.

For illustrative purposes only, examples of economic loss could be tax or penalty spaces addressing (1) rent money lost by a person who returned to live with parents, (2) loss of insurance coverage over a telemedicine visit, (3) loss from use of ineffective immunity test kits and (4) loss of a bed and breakfast deposit. Again, these are for illustrative purposes only and undoubted pale in comparison to the numerous losses of life and depletion of life savings many have suffered during the pandemic.

Four corner spaces of the game board are a Begin Journey space, Go into ICU Quarantine space, In Quarantine/Only Visiting space and an Obtain Stimulus Funds space. The game preferably includes the ability to draw cards which provide educational and/or even sometimes amusing aspects (if that is even possible!) of the pandemic.

During game play, a player owning a complete set of locations of one color may purchase clinics to place on his/her location and will receive increased rent as shown on each location deed. A player may propose a potential transaction to another player when it is the proposing player's turn.

BRIEF DESCRIPTION OF THE DRAWINGS

The invention will be better understood with reference to the Detailed Description of the Preferred Embodiment, with reference to the drawing, of which:

FIG. 4 shows examples of "Mask" cards from the Covidopoly 19 game;

DETAILED DESCRIPTION OF THE PREFERRED EMBODIMENT

Figure 1:
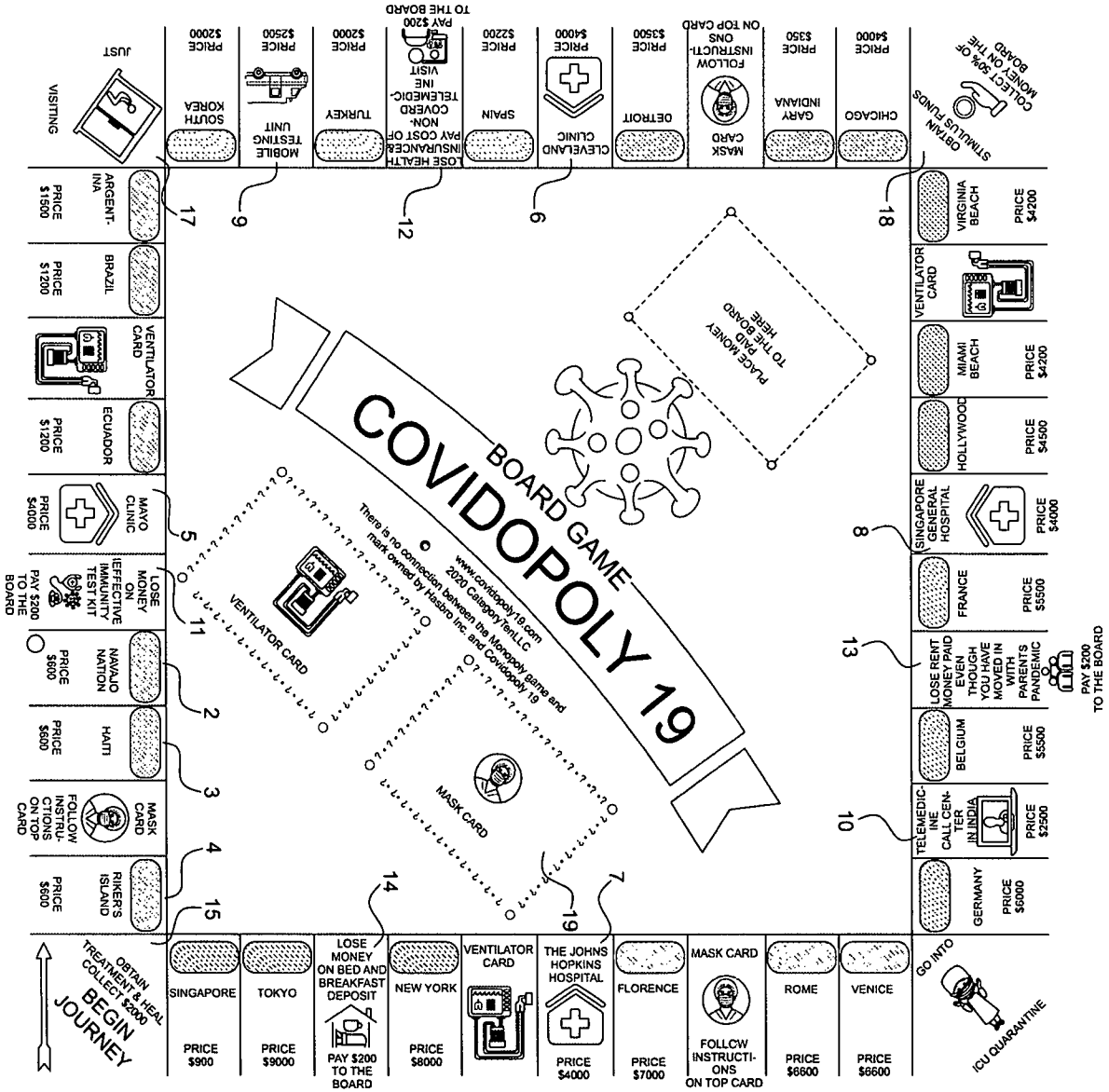
FIG. 1 is a plan view of a Covidopoly 19 game board.
Figure 2:
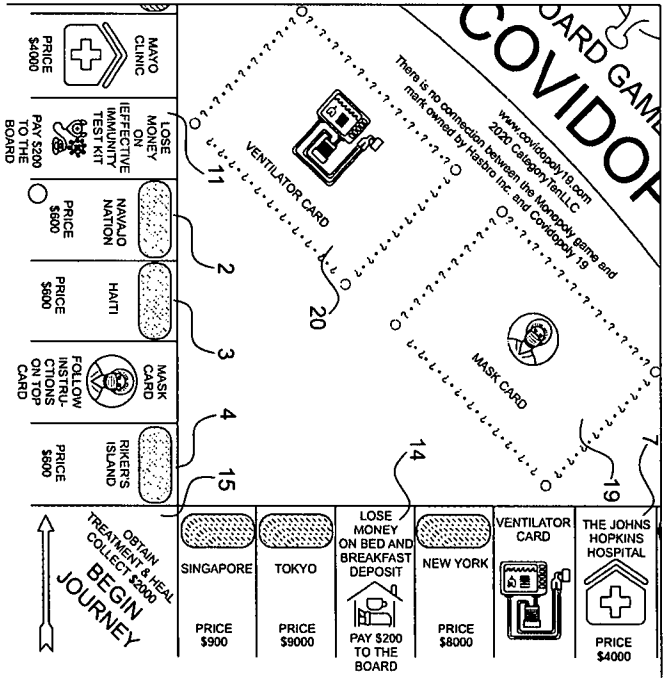
FIG. 2 is an enlarged plan view of several example locations from the board of FIG. 1.
Figure 3:
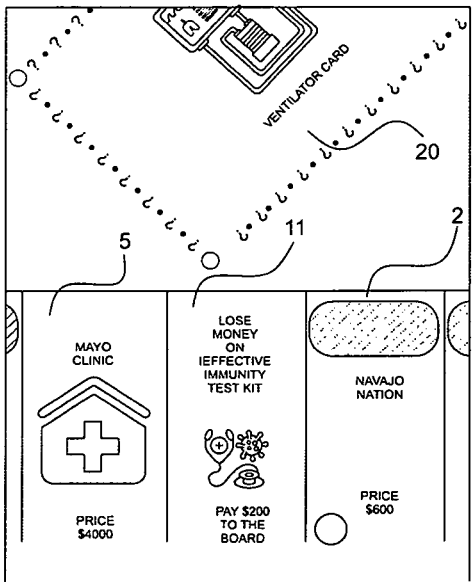
FIG. 3 is an enlarged plan view of the board of FIG. 1, showing an example of a tax or penalty space.

The Board Game comprises a preferably square game board 1, preferably about 16"×16" and which may be foldable to be stored and shipped in a smaller game box. Of course different dimension board may be used or the board could be electronic and the game played electronically as well. The game board 1 preferably has 40 spaces hereon, comprising 24 geographical locations or places in colored groupings of threes. The geographical locations or places have some significance in the novel coronavirus 2019-2020 pandemic. As an example (see FIG. 2), one color grouping includes Navajo Nation 2, Haiti 3, and Riker's Island 4, all of which have suffered greatly during the pandemic. (As have numerous other places around the world). Other spaces include four leading hospitals of the world, including, the Mayo Clinic 5, the Cleveland clinic 6, The Johns Hopkins Hospital 7 and Singapore General Hospital 8. Two other spaces include a Mobile Testing Unit 9 and a Telemedicine Call Center in India 10.

There are four tax or penalty spaces 11, 12, 13, 14 (see FIG. 2) which address examples of economic loss suffered in different ways during the pandemic, including (1) rent money lost by a person who returned to live with parents, (2) loss of insurance coverage over a telemedicine visit, (3) loss from use of ineffective immunity test kits and (4) loss of a bed and breakfast deposit.

The four corner spaces of the Board 1 are a Begin Journey space 15, Go Into ICU Quarantine space 16, In Quarantine/Only Visiting space 17 and an Obtain Stimulus Funds space 18.

Figure 5:
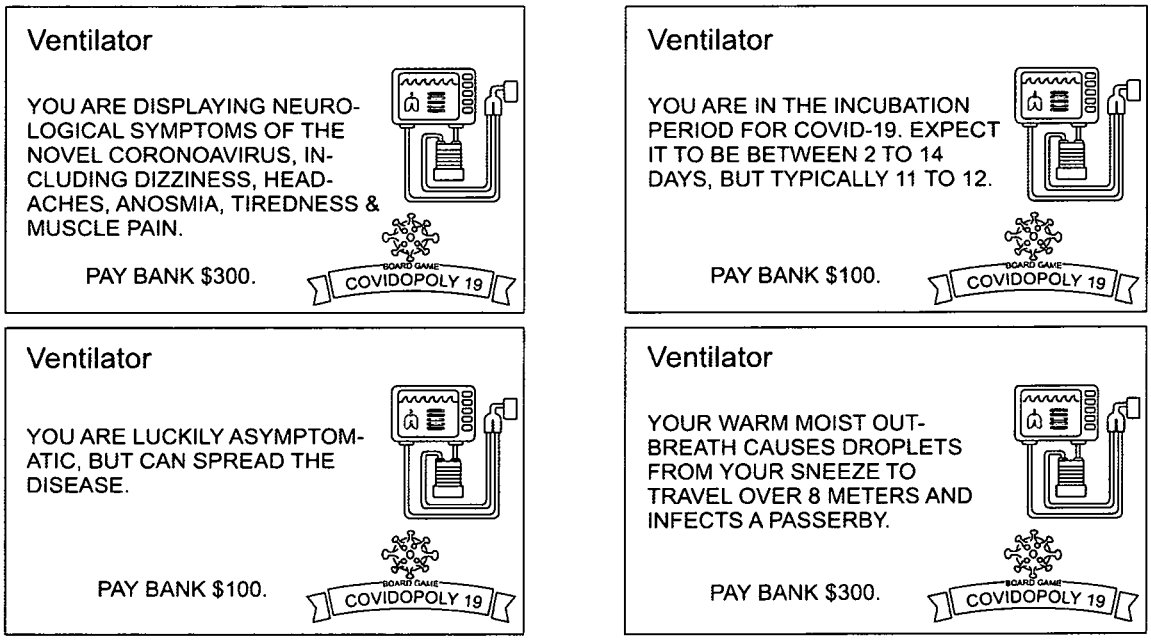
FIG. 5 shows examples of "Ventilator" cards from the Covidopoly 19 game.

An important educational and sometimes amusing aspect of the game are the "Mask" and "Ventilator" cards (see examples in FIGS. 4 and 5 respectively). Some of the cards are meant to be funny. For example "You keep overeating during the lockdown. Your belly is the curve that needs to be flattened. Pay $100." But most are meant to be educational—for instance: "You are displaying neurological symptoms of the novel coronavirus, including dizziness, headaches, anosmia, tiredness and muscle pain. Pay $300."

Figure 6:
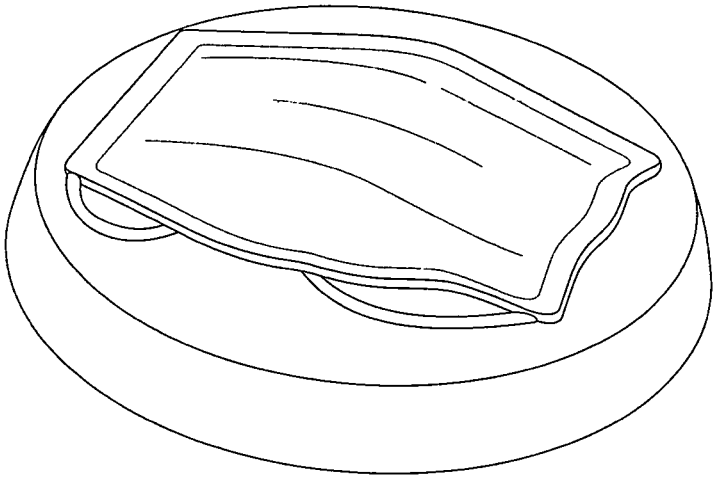
FIG. 6 shows an example of a game piece from the Covidopoly 19 game.

The game is played with two or more players and the setup includes placing the mask and ventilator cards (face down) in the respective rectangles 19, 20 on the game board 1. Each player selects a game piece (see an example of a game piece in FIG. 6—although most any type of piece may be used) and places it on the Begin Journey space 15. Each player is distributed $20,000 to start the game.

Figure 7:
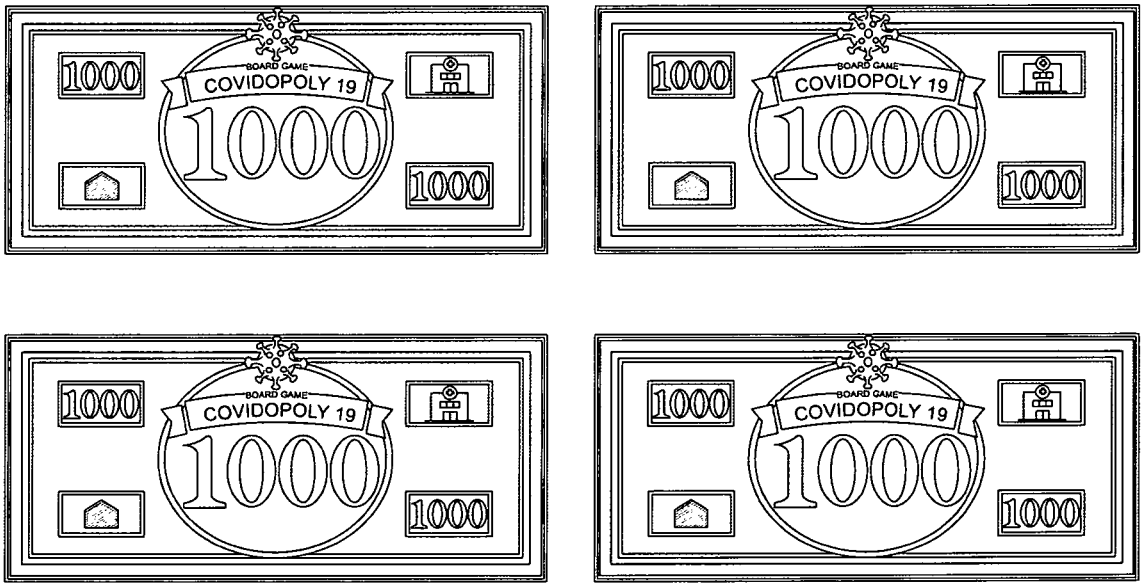
FIG. 7 is an example of the currency used in the Covidopoly 19 game.

FIG. 7 shows an example of the currency used. Of course a different amount may be chosen to be distributed. One player is designated as the "banker" and holds all the undistributed money. Another player preferably is designated the location manager and hold the location deeds, clinics and hospitals.

To begin the game, a player roll three dice and moves his/her game piece according to the combined total. If a player lands on a colored location, hospital 5, 6, 7 or 8, mobile testing unit 9 or the telemedicine call center 10, he/she has the option of purchasing the same, for which he/she must pay the price indicated on the board, to the Bank. In exchange, he/she will receive the deed to the location and receives rent when another player lands thereon. The amount of rent to be paid is listed on each deed. A player who owns all of the locations in a color group may purchase clinics and hospitals for the locations according to the game rules.

A player who lands on a location, for which a single player owns that location and all other locations within that color group and where no clinics exist on the property landed upon, must pay to the bank one-and-a-half times the rent indicated on the card.

A player rolling a "triple" i.e., three identical amounts on each dice (for instance, all ones or all twos . . . or all sixes) receives another turn and rolls again. A player rolling a "ladder" of three consecutive numbers among the dice rolled (for instance 1, 2 and 3 or 2, 3 and 4 . . . or 4, 5 and 6) receives another turn and rolls again.

A location may be "mortgaged" back to the bank upon payment to the bank of the indicated mortgage value listed on the deed. (For example, Riker's Island 4 may be mortgaged for $300). When mortgaged, the deed should be flipped over, but held by the player who owned the location. Any other player landing on the location will not be assessed rent while the property is mortgaged. The property may be unmortgage by the owner paying to the bank 75% of the location sale price. For example, once mortgaged, Riker's Island 4 may be unmortgaged for $450.

A player owning a complete set of locations of one color (for example Navajo Nation 2, Haiti 3 and Riker's Island 4) may purchase clinics to place on his/her location and will receive increased rent as shown on each location deed. Clinics (not shown) purchased must be divided as evenly as possible. (For example, one may not place two clinics on Navajo Nation 2 and none on Riker's Island 4 and Haiti 3). Once there are four clinics on every location within a particular color group, the owner may purchase a hospital (not shown) in place of the four clinics for the price as indicated on the deed. Purchased clinics and hospitals may not be moved from one location to another. No clinics or hospitals are placeable on the Mobile Testing Unit 9, the Telemedicine Call Center 10 or on any of the hospitals (the Mayo Clinic 5, Cleveland Clinic 6, Johns Hopkins Hospital 7 or Singapore General Hospital 8).

A player may propose a potential transaction to another player when it is the proposing player's turn.

A player is out of the game if he/she runs out of money and has no property to mortgage back to the bank.

While the preferred embodiments of the invention have been depicted in detail, it will be understood that modifications, adaptions, additions, or omissions may be made, without departing from the spirit and scope of the invention, as delineated in the following claims:

I claim:

1. A game for one or more players, said game comprising:
- a surface with spaces thereon;
- a game piece;
- a random generator configured to delineate where the piece is to be moved;
- wherein at least one of the spaces on said surface is a location of significance to the novel coronavirus pandemic,
- wherein the location includes a health-related location,
- wherein a player is imposed to pay a game currency when the piece of the player is located on the health-related location,
- wherein the health-related location includes a stimulus fund space that is located in one of the four corners of the surface,
- wherein 50% of the game currency on the surface is obtained by a player when the piece of the player is located on the stimulus fund space,
- wherein the other three corners of the surface include:
  - a begin journey space where the player obtains the game currency for a treatment and a heal;
  - a quarantine space; and
  - a quarantine/only visiting space,
- wherein a plurality of mask card spaces, where the player is instructed to draw a mask card, are located on the surface; and
- a plurality of ventilator card spaces, where the player is instructed to draw a ventilator card, are located on the surface.

2. The game of claim 1, wherein said surface is electronic.

3. The game of claim 1, wherein said surface is a substrate.

4. The game of claim 3, wherein said substrate is substantially rectangular.

5. The game of claim 4, wherein said substrate is square shaped.

6. The game of claim 5, wherein said substrate is foldable.

7. The game of claim 1, wherein said locations are arranged by indicia into set groups.

8. The game of claim 1, wherein landing on certain spaces lead to learning of additional information.

9. The game of claim 8, wherein said additional information also relates to the novel coronavirus pandemic.

10. The game of claim 9, wherein said additional information are on cards.

11. The game of claim 1, wherein clinics and hospitals may be purchased when one player owns every location of a set group of locations.

12. The game of claim 11, wherein the one player is imposed to pay one-and-a-half times a rent indicated on a card when the one player does not purchase the clinics or the hospitals and when the piece of the one player is stopped on one of the locations of the set group of the locations.

13. The game of claim 11, wherein the one player receives an increased rent as shown on a location when the one player purchased the clinics or the hospitals on the location and a piece of other players is stopped on the location.

14. The game of claim 11, wherein there are no two or more clinics or hospitals on any locations on the surface.

15. The game of claim 11, wherein the clinics or hospitals are not moved from a location where the one player purchased.

16. The game of claim 1,
- wherein the health-related location includes a health equipment location, and
- wherein a health equipment card is drawn when the piece is located on the health equipment location.

17. The game of claim 1,
- wherein the mask card instructs the player to pay the game currency to a game financial institution or to obtain the game currency from the game financial institution; and
- wherein the ventilator card instructs the player to pay the game currency to the game financial institution.

18. The game of claim 1, wherein the mask card is placed on a first space around the center of the surface; and wherein the ventilator card is placed on a second space around the center of the surface.

19. A game for one or more players, said game comprising:

a substantially square substrate with spaces thereon;

a game piece;

a random generator configured to delineate where the piece is to be moved;

wherein a plurality of the spaces on the substrate represents locations having significance to the novel coronavirus pandemic and wherein said locations are arranged in groupings;

wherein another plurality of spaces allows player to draw cards from which additional information may be learned about the novel coronavirus pandemic, wherein at least one of the locations includes a health-related location, and wherein a player is imposed to pay a game currency when the piece of the player is located on the health-related location, wherein the health-related location includes a stimulus fund space that is located in one of the four corners of the surface, wherein 50% of the game currency on the surface is obtained by a player when the piece of the player is located on the stimulus fund space, wherein the other three corners of the surface include:

a begin journey space where the player obtains the game currency for a treatment and a heal;

a quarantine space; and a quarantine/only visiting space, wherein a plurality of mask card spaces, where the player is instructed to draw a mask card, are located on the surface; and a plurality of ventilator card spaces, where the player is instructed to draw a ventilator card, are located on the surface.

20. A game for one or more players, said game, comprising:

a surface with spaces thereon;

a game piece;

means for delineating where the piece is to be moved;

wherein at least one of the spaces on said surface is a location of significance to the novel coronavirus pandemic, wherein clinics and hospitals may be purchased when one player owns every location of a set group of locations, and wherein the one player is imposed to pay one-and-a-half times a rent indicated on a card when the one player does not purchase the clinics or the hospitals and when the piece of the one player is stopped on one of the locations of the set group of the locations, wherein the health-related location includes a stimulus fund space that is located in one of the four corners of the surface, wherein 50% of the game currency on the surface is obtained by a player when the piece of the player is located on the stimulus fund space, wherein the other three corners of the surface include:

a begin journey space where the player obtains the game currency for a treatment and a heal;

a quarantine space; and a quarantine/only visiting space, wherein a plurality of mask card spaces, where the player is instructed to draw a mask card, are located on the surface; and a plurality of ventilator card spaces, where the player is instructed to draw a ventilator card, are located on the surface.

* * * * *